US006566831B1

(12) United States Patent
Waite

(10) Patent No.: US 6,566,831 B1
(45) Date of Patent: May 20, 2003

(54) SENSOR FOR ADJUSTABLE VEHICLE SYSTEMS

(75) Inventor: Daryn L. Waite, Mount Prospect, IL (US)

(73) Assignee: Indak Manufacturing Corporation, Northbrook, IL (US)

( * ) Notice: Subject to any disclaimer, the term of this patent is extended or adjusted under 35 U.S.C. 154(b) by 55 days.

(21) Appl. No.: 09/685,864

(22) Filed: Oct. 10, 2000

(51) Int. Cl.[7] ..... G05G 1/14

(52) U.S. Cl. ..... 318/551; 318/550; 74/513; 74/560

(58) Field of Search ..... 318/543, 549, 318/550, 551, 552; 74/512, 513, 514, 560

(56) References Cited

U.S. PATENT DOCUMENTS 4,399,393 A * 8/1983 Santini ..... 318/139 X
5,532,671 A * 7/1996 Bachman et al. ..... 340/438
5,819,593 A * 10/1998 Rixon et al. ..... 74/514
6,330,838 B1 * 12/2001 Kalsi ..... 74/514
6,352,007 B1 * 3/2002 Zhang et al. ..... 74/512
6,360,631 B1 * 3/2002 Wortmann et al. ..... 74/513

OTHER PUBLICATIONS

"Control Modules", http://www.indak.com/products/automotive/control_modules.htm, The Indak Group, Jan. 17, 2001.

"Switches", http://www.indak.com/products/automotive/control.htm,The Indak Group, Jan. 17, 2001.

* cited by examiner

*Primary Examiner*—Bentsu Ro
(74) *Attorney, Agent, or Firm*—Wallenstein & Wagner, Ltd.

(57) ABSTRACT

The present invention provides a sensor for an adjustable system of a vehicle. The sensor is utilized to facilitate monitoring of adjustment positions with respect to a reference in the system. The sensor comprises a mechanical interface that allows for the input of movement and an electrical device coupled to the mechanical interface that is capable of changing an electrical signal in relation to the movement of the mechanical interface. The electrical signal, which is proportional to the movement input to the mechanical interface, is utilized by a control unit for control purposes, such as to control the positioning of vehicle control pedals, control the positioning of an adjustable seat of a vehicle, or to control the temperature adjustment in a vehicle HVAC system.

8 Claims, 5 Drawing Sheets

SENSOR FOR ADJUSTABLE VEHICLE SYSTEMS

TECHNICAL FIELD

The present invention generally relates to adjustable systems for vehicles, and more particularly to a sensor for an adjustable system of a vehicle, such as an electronically adjustable vehicle pedal system of an automobile.

BACKGROUND OF THE INVENTION

Most vehicles, such as automobiles, include adjustable electrical, mechanical, and electromechanical systems that perform various functions. One such system is an adjustable pedal system for a vehicle, which includes one or more control pedals for the vehicle, such as an accelerator pedal, brake pedal, and/or a clutch pedal. In recent years, adjustable pedal systems have gained considerable market acceptance, particularly in the automotive industry. Adjustable pedal systems provide mechanisms and controls for adjusting the position of the control pedals in relation to the driver's position within the vehicle. The relative height of the control pedals can therefore be adjusted to accommodate multiple drivers each having differing anatomic dimensions and relative body proportions.

Presently known vehicle pedal adjusting mechanisms typically utilize a single motor operatively connected to two control pedals via two separate adjustment mechanisms. One of the pedals is typically connected to the motor via a worm gear train or other gear mechanism and the other pedal is typically connected to the motor via a flexible cable. While this type of system provides relative adjustment between the two pedals, it does not provide a sensor for monitoring the relative positions of the two pedals. In the event of a mechanical failure of only one of the two mechanisms, a serious safety hazard would be created if the driver were to adjust the pedal having the properly functioning mechanism substantially out of position with respect to the pedal having the defective mechanism.

Provisional patent application Ser. No. 60/164,434, filed on Nov. 9, 1999 and assigned to the Assignee of the present invention, discloses an electromechanical pedal adjustment system. The system utilizes two linear motion safety switches each adapted to be mechanically connected between one of the pedals and a yoke that is pivotally connected to the pedal. Each of the switches are operable through linear movement created by movement of the pedal with respect to the yoke. Each switch includes linearly moveable contactors and associated contacts that are spaced apart along the length of the switch travel. The contactors and the contacts are part of an energizing circuit for the pedal adjusting motor that is only operable when the pedals are adjusted to the same, or nearly the same height. Thus, if a fault develops in the switches or an electrical circuit, the circuit is de-energized so that the motor will not operate until the system is repaired. While this type of system prevents substantial misalignment of the pedals, it does not provide for determination of absolute positioning of the pedals.

Another presently known system utilizes a potentiometer (often referred to as a "pot") to monitor the height of the pedals. In this type of system, a pot is operatively connected to each pedal to create an output voltage that is proportional to the position of the pedal. The pot is mechanically coupled to an armature of a pedal adjustment motor by means of a large ratio gear train. The gear train reduces the number of revolutions the motor will normally rotate during complete travel of the pedals within their range of movement (typically several hundred revolutions) to less than one revolution. Thus, complete travel of the pedal from one end of its moveable range to the other corresponds to less than one revolution of the pot. When the pedal is adjusted via the motor, the motor also causes rotation of the contactor of the pot, thereby creating a variable voltage signal. The output voltages of each of the pots are compared by electronic circuitry to determine the difference between the output voltages. If the voltage difference exceeds a predetermined level corresponding to a fault condition, the motor is de-energized so that no further adjustment of the pedals is possible until the fault condition is addressed and/or repaired by a technician.

A significant disadvantage of this system is that failure of any of the mechanical linkage components between the motor and the pedal, such as the flexible drive cable, worm gears, pinions, drive clevis, etc., cannot be detected. This is because the pot is coupled to the motor. If the cable were to break and render one of the pedals adjustably inoperable, the pot would still generate a variable voltage signal. Thus, the motor could still be commanded to adjust the functioning pedal and the fault in the system would remain undetected.

Another disadvantage of this particular system is the complexity and relative high cost to manufacture and assemble the gear train requiring the large gear reduction.

Yet another disadvantage of this particular system is that it does not have an environmental seal adequate for most automotive applications. Exposure to various environmental conditions can cause failure of one or more electrical elements of the system and possibly create an intermittent or open electrical circuit. For example, during typical winter conditions when salt is utilized to melt ice and snow on the roads, salt water vapor may enter the electrical contact region of the pot and cause corrosion of the contacts. As an additional example, if the vehicle is used in dusty or dirty conditions, such as those found on a construction site or in the desert, airborne particulate matter may enter the pot and cause malfunction of the system.

The present invention solves all of the aforementioned problems and provides a robust design for a sensor of a vehicle pedal adjustment system.

SUMMARY OF THE INVENTION

The present invention provides a sensor for an adjustable system of a vehicle. The sensor is utilized to facilitate monitoring of adjustment positions with respect to a reference in the system. The sensor comprises a mechanical interface that allows for the input of movement and an electrical device coupled to the mechanical interface that is capable of changing an electrical signal in relation to the movement of the mechanical interface. The electrical signal, which is proportional to the movement input to the mechanical interface, is utilized by a control unit for control purposes, such as to control the positioning of vehicle control pedals, control the positioning of an adjustable seat of a vehicle, or to control the temperature adjustment in a vehicle HVAC system.

In a specific embodiment, the sensor includes a mechanical interface in communication with a pedal of an adjustable vehicle pedal assembly such that positional adjustment of the pedal imparts linear motion to the mechanical interface. The mechanical interface includes a mechanism that provides rotational motion from the imparted linear motion. An electrical device coupled to the mechanical interface is capable of changing an electrical signal in relation to the rotational movement provided by the mechanism of the mechanical interface. The rotational movement allows for a more effective sealing arrangement to protect the electrical device from adverse environmental conditions, especially in automotive applications.

In another embodiment, the sensor includes a mechanical interface including a shaft having a bearing surface and a carriage having a bearing surface that mates with the bearing surface of the shaft. The carriage is coupled to a portion of the pedal assembly to allow linear movement in response to position adjustment of the pedal. Thus, the linear movement of the carriage causes rotational movement of the shaft, which is coupled to an electrical device that is capable of changing an electrical signal associated with a control unit in relation to the rotational movement of the shaft.

The present invention also includes an adjustable pedal system for a vehicle having at least two vehicle control pedals. The system of the present invention comprises a motorized adjustment mechanism coupled to each pedal that effectuates movement of the pedal to an adjusted position, an electrical device coupled to each pedal and associated with an electrical circuit, and a control module in communication with the electrical circuit. The electrical device is capable of changing an electrical signal of the electrical circuit in relation to the adjusted position of the pedal and the control module controls the adjustment mechanism based on the electrical signal of the electrical circuit.

The present invention sensor can also be utilized in an adjustable seat system for a vehicle, wherein a sensor is coupled to a moveable member within the adjustment assembly associated with each axis of movement. The sensors provide a variable electrical signal that corresponds to positioning for each axis. The variable electrical signals are then utilized by a control unit to control the positioning of the seat.

The present invention sensor can also be utilized as a adjustable control in an instrument panel that requires a linear motion input by an operator of a vehicle. In a specific application, the sensor can be utilized in a vehicle HVAC system as an adjustable temperature control, wherein an operator can slide the mechanical interface to adjust the temperature output of the heating system of the automobile. The sliding of the mechanical interface would effectuate application of motion to the electrical device of the sensor to provide a variable electrical signal, which can then be used to provide variable temperature control to the system.

These and other aspects of the present invention will become apparent after consideration of the specification and the accompanying drawings.

DETAILED DESCRIPTION OF THE PREFERRED EMBODIMENTS

Figure 1:
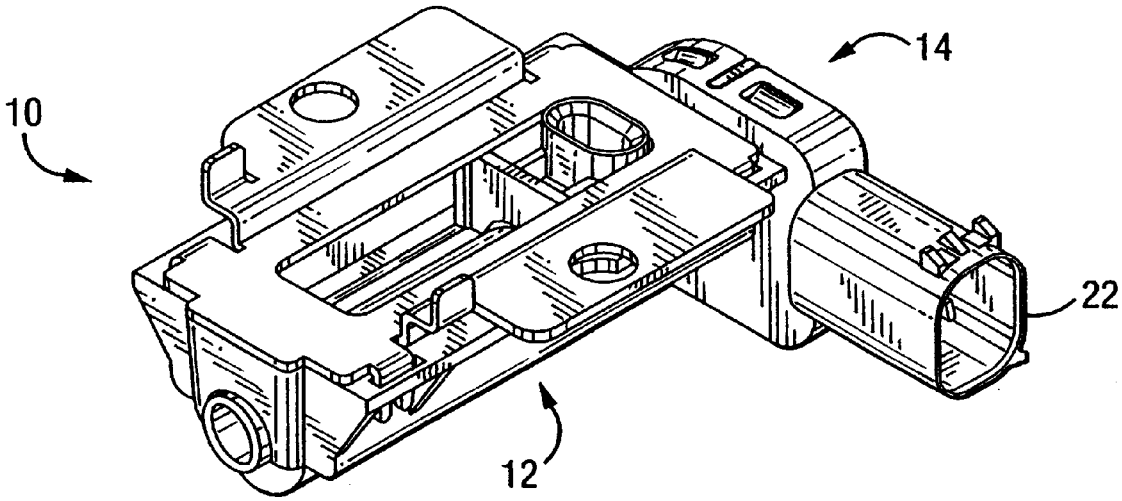
FIG. 1 is a perspective view of an embodiment of a sensor according to the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Figure 2:
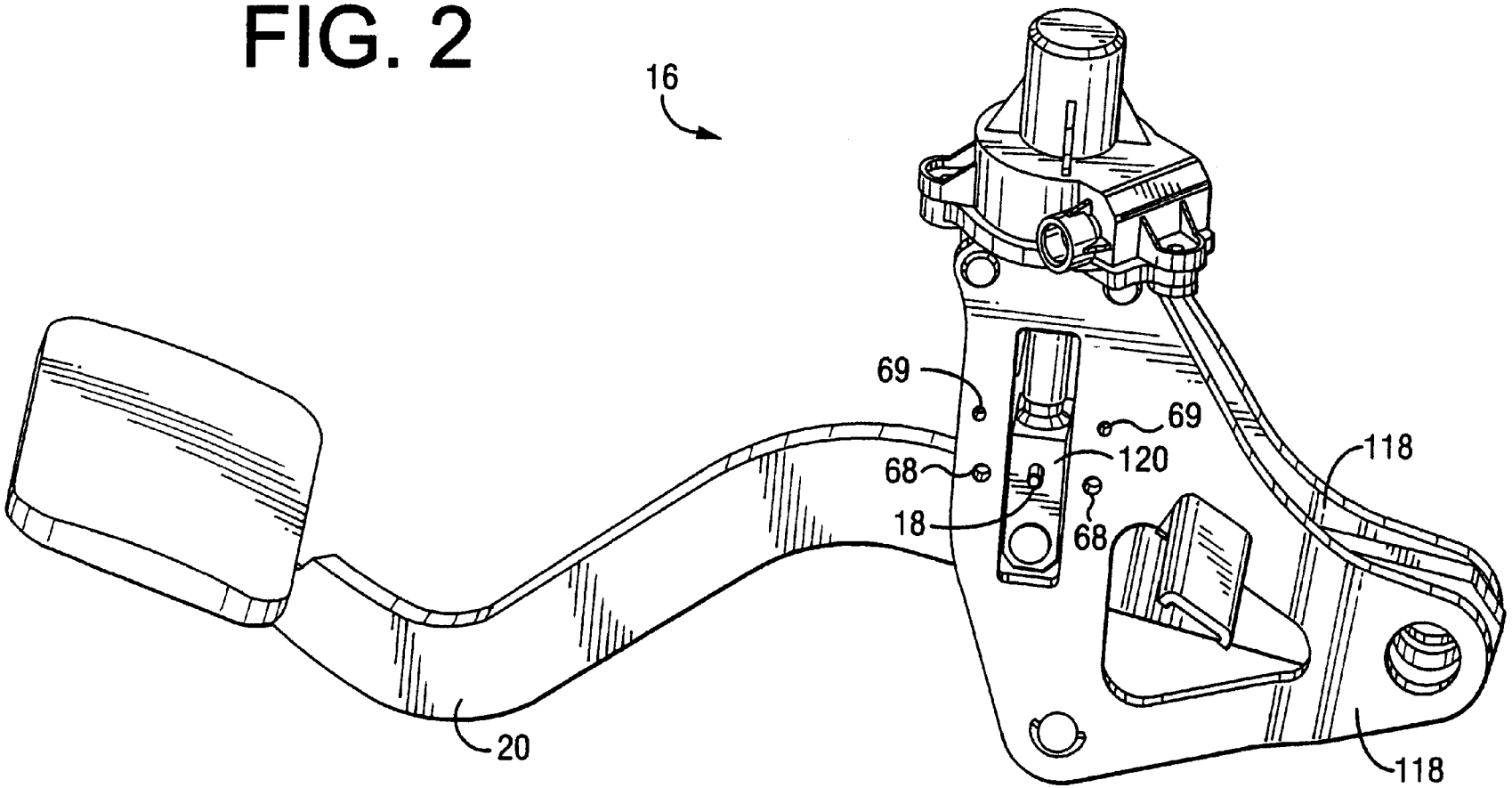
FIG. 2 is a perspective view of a vehicle pedal assembly.
Figure 3:
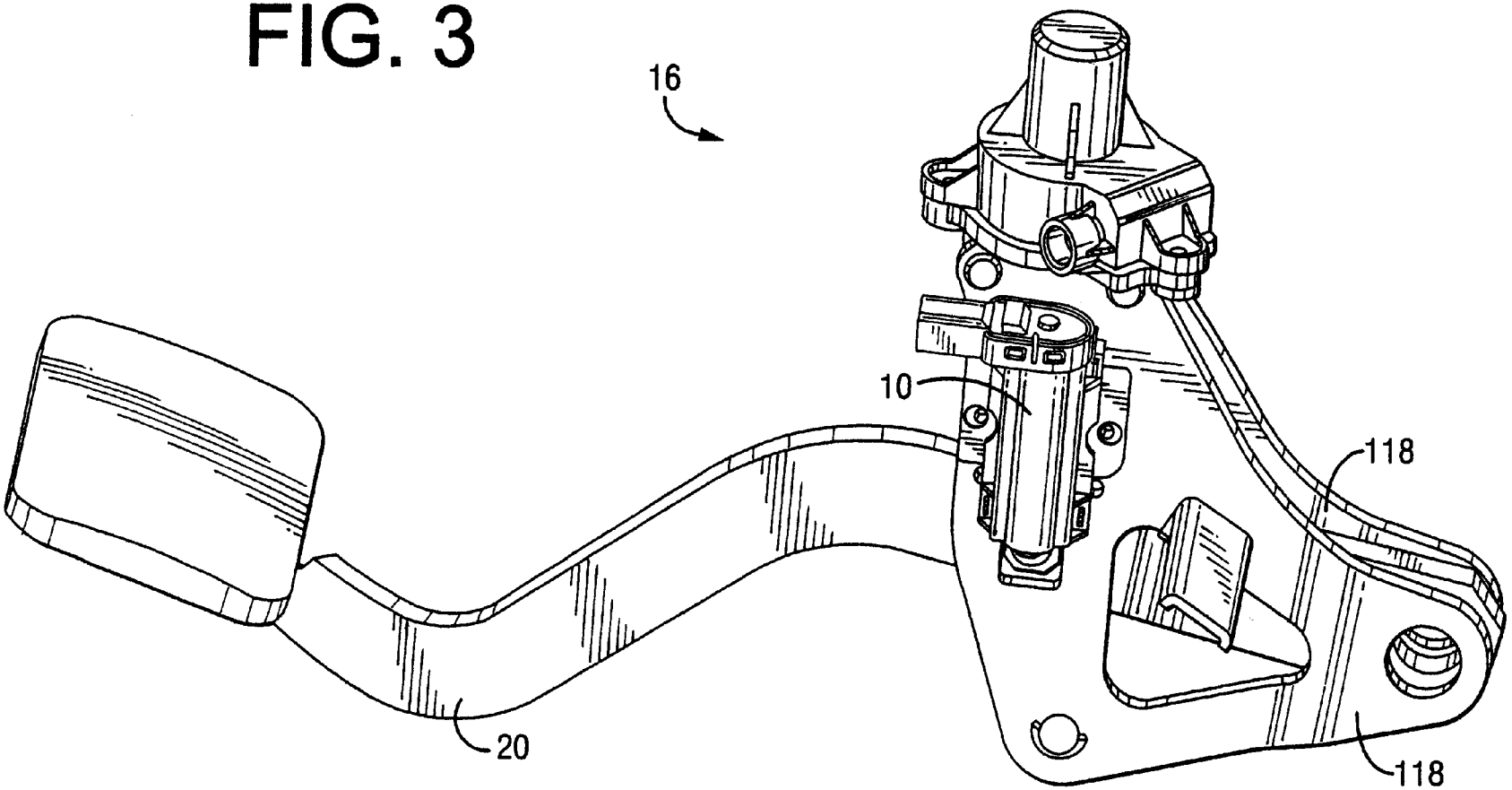
FIG. 3 is a perspective view of the vehicle pedal assembly of FIG. 2 having the sensor of FIG. 1 installed thereto.

FIG. 1 shows a sensor 10 of the present invention for use with an adjustable pedal system of a vehicle. The sensor 10 is utilized to facilitate monitoring of pedal adjustment positions. In its basic form, the sensor 10 includes a mechanical interface portion 12 and an electrical device portion 14, as shown in FIG. 1. An adjustable pedal assembly 16 is shown in FIG. 2 without the sensor 10 installed thereto. As shown in FIG. 2, the assembly 16 includes a pin 18 that moves in relation to adjustment of a pedal 20. When the sensor 10 is installed, the mechanical interface 12 of the sensor is coupled to the pin 18 of the pedal assembly 16, as shown in FIG. 3. Thus, movement is applied to the mechanical interface 12 via the pin 18. The electrical device portion 14 is coupled to the mechanical interface 12, wherein the electrical device portion 14 is capable of changing an electrical signal in relation to the movement provided by the mechanical interface 12. The electrical signal is proportional to the adjusted position of the pedal 20.

Figure 4:
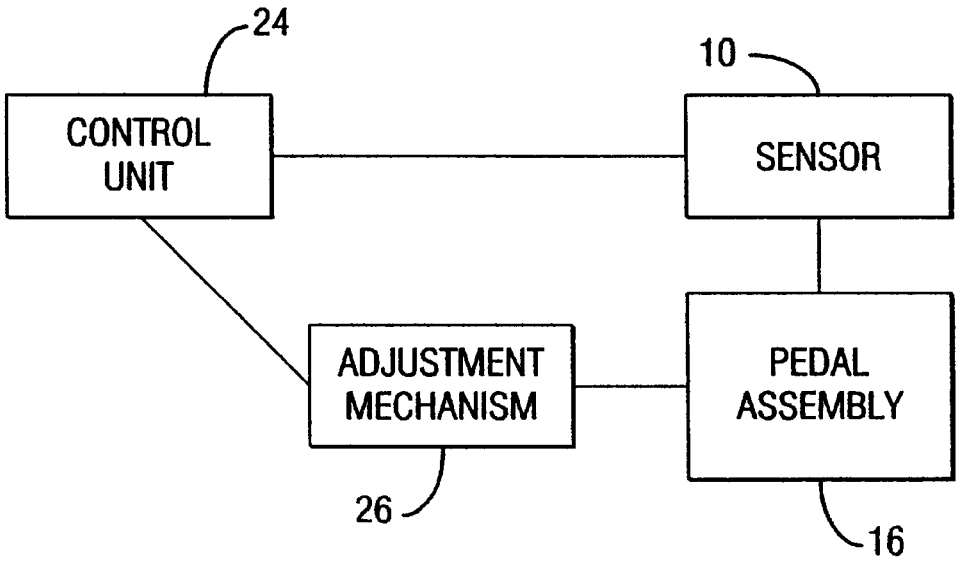
FIG. 4 is a block diagram of an adjustable vehicle pedal system according to the present invention.

The sensor 10 is connected to a control circuit via a connector plug 22, as shown in FIG. 1. The block diagram in FIG. 4 depicts the basic control loop of the system of the present invention for one pedal. Each pedal of the system is associated with a sensor. The electrical device portion 14 of the sensor 10 provides a change in an electrical signal in the control circuit. A control unit 24 in communication with the control circuit determines whether positioning of the pedal 20 of the pedal assembly 16 is within a predetermined allowable range with respect to the position of the other pedal or pedals (not shown). In one embodiment, this is done by comparing the values of the electrical signals received by the pedals with a predetermined allowable range of values, or, alternatively, by comparing the divergence of the values with a predetermined allowable divergence value. As shown in the block diagram of FIG. 4, the control unit 24 is in communication with a motorized adjustment mechanism 26, which effectuates adjustment of the pedal 20 of the pedal assembly 16. If the appropriate value of the electrical signal for any of the pedals is outside the predetermined range, a fault condition occurs and the control unit 24 disables the adjustment mechanism 26. The adjustment mechanism 26 remains disabled until a technician can evaluate the fault condition and reset the control unit 24. In yet another embodiment, the value of the electrical signal for one or more of the pedals may be monitored in conjunction with a pulse received by a Hall effect sensor in communication with a motor of the motorized adjustment mechanism 26. In this alternative embodiment, a mechanical failure is detected when a pulse is received from the Hall effect sensor (which indicates that the motor is operating to adjust the pedal) and the electrical signal associated with the appropriate pedal is constant (which indicates that the pedal position remains fixed). An important aspect of the present invention is that the sensor 10 does not derive its input directly from the motor, thereby allowing detection of mechanical system failures "downstream" of the motor within the pedal assembly 16.

Figure 5:
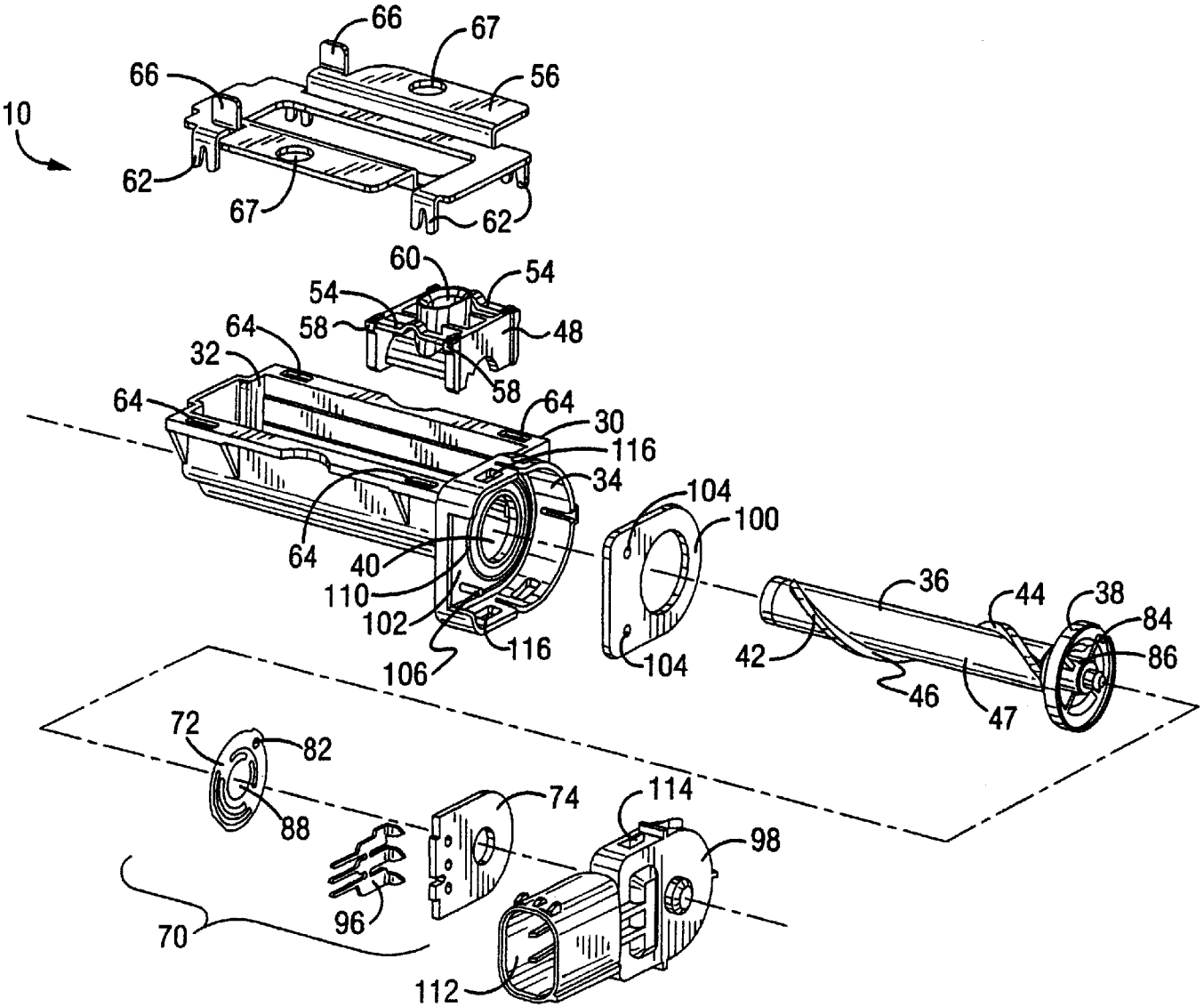
FIG. 5 is an exploded assembly view of the sensor of FIG. 1.

The sensor 10 is now described in more detail with reference to FIGS. 5–7. An important aspect of this embodiment is the conversion of linear movement effectuated by the pin 18 of the pedal assembly 16 to rotational movement via the mechanical interface portion 12 of the sensor 10. Rotational movement allows for a more effective sealing arrangement than a seal associated with linear motion, as will be described later. Referring now to FIG. 5, the sensor 10 includes a housing 30 having a mechanical interface compartment 32 and an electrical device compartment 34. The mechanical interface compartment 32 and the electrical device compartment 34 are disposed adjacent to each other. A shaft 36 having a flange 38 is disposed through an aperture 40 within the housing 30 such that the shaft 36 is positioned within the mechanical interface compartment 32 while the flange 38 is positioned within the electrical device compartment 34. The shaft 36 includes a helical rib 42 having a bearing surface 44 and a bearing surface 46. The helical rib 42 is disposed on an outer cylindrical surface 47 of the shaft 36.

A carriage 48 is disposed within the mechanical interface compartment 32 to allow linear movement of the carriage 48 therein. As shown in FIG. 6, the carriage 48 includes a first bearing surface 50 and a second bearing surface 52. The bearing surfaces 50 and 52 mate with the bearing surfaces 44 and 46 of the shaft 36, respectively. Additionally, the carriage includes bearing surfaces 53, which bear against the outer cylindrical surface 47 of the shaft 36 when the carriage 48 is assembled within the sensor 10. The interaction of the bearing surfaces 53 with the outer cylindrical surface 47 of the shaft 36 prevents twisting of the carriage 48 with respect to the shaft 36 when engaged with each other. In an alternative embodiment, the carriage 48 and the shaft 36 may be provided with only one bearing surface. In yet another alternative embodiment, the carriage 48 can be provided with one or more ribs that correspondingly mate with a helical slot on the shaft 36. In any of these embodiments, linear motion of the carriage 48 causes the shaft 36 to rotate. The helical rib 42 on the shaft 36 is dimensioned such that one complete translation of the carriage 48 within the mechanical interface compartment 32 results in less than one revolution of the shaft 36.

Figure 6:
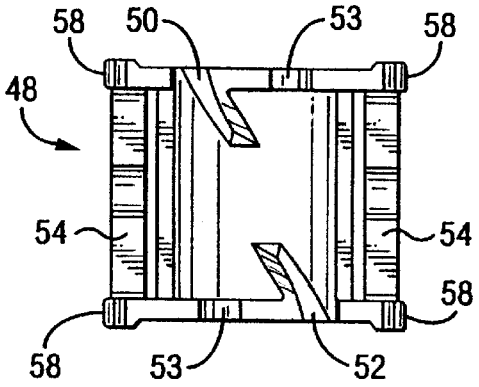
FIG. 6 is a bottom plan view of a carriage that couples with a shaft of a preferred embodiment of the sensor.
Figure 7:
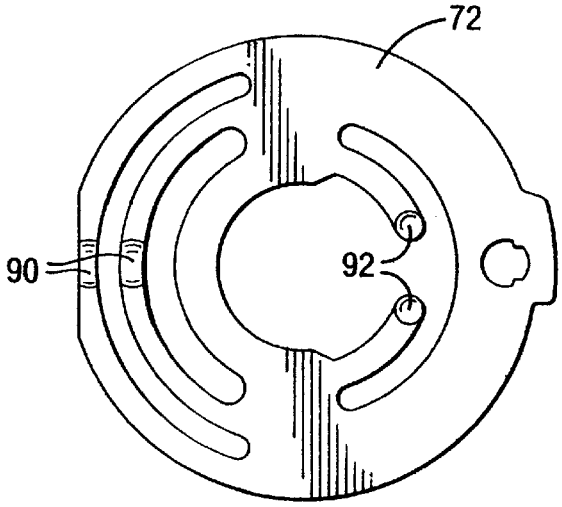
FIG. 7 is a top plan view of a contactor of a potentiometer utilized in a preferred embodiment of the sensor.

The carriage 48 also includes two spring beams 54, as shown in FIGS. 5 and 6. A mounting plate 56 is attached to the housing 30 over the mechanical interface compartment 32 such that the mounting plate 56 deflects the spring beams 52 and applies a downward pressure to the carriage 48, which ensures proper engagement between the carriage 48 and the shaft 36. The carriage 48 includes bearing protrusions 58 to allow for minimal clearance between the mechanical interface compartment 32 and the carriage 48, thus limiting any twist of the carriage 48 within the mechanical interface compartment 32. The carriage 48 also includes an aperture 60 that engages the pin 18 when mounted to the pedal assembly 16. The mounting plate 56 includes split tabs 62 that snap into slots 64 within the housing 30. The mounting plate 56 also includes tabs 66 and mounting holes 67 that allow mounting of the sensor 10 to the pedal assembly, as shown in FIG. 3. In a preferred embodiment, the tabs 66 and the mounting holes 67 are designed as part of a keying arrangement with a set of corresponding mounting holes 68 and 69 in the pedal assembly 16, as shown in FIG. 2. The holes 69 are smaller in diameter than the holes 68. In the keying arrangement, the centerline spacing between the tabs 66 (and the corresponding mounting holes 68) is smaller than the centerline spacing of the mounting holes 67 (and the corresponding mounting holes 69). Furthermore, the width of each tab 66 is dimensioned to fit within the larger holes 68. Thus, the keying arrangement provides for precise placement of the sensor 10 and prevents it from being mounted incorrectly.

Figure 8:
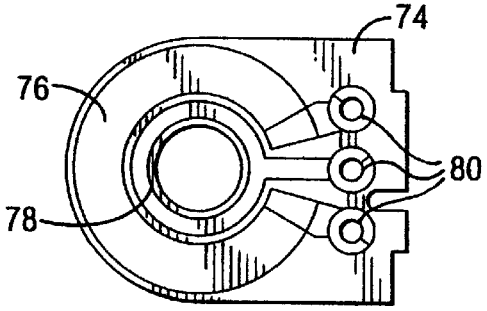
FIG. 8 is a top plan view of a PC board having contact paths that interact with the contactor of FIG. 7.

In a preferred embodiment, the electrical device portion 14 of the sensor 10 utilizes a potentiometer 70 coupled to the mechanical interface portion 12. Alternatively, other types of electrical devices may be utilized, such as a rotary encoder, a rotary switch, a Hall effect sensor, or the like. The potentiometer 70 is formed through the interaction of a contactor 72 and a PC board 74 having contactor paths 76 and 78, and a terminal set 80 to form a voltage divider circuit, as shown in FIGS. 7 and 8. Referring again to FIG. 5, the contactor 72 attaches to the flange 38 of the shaft 36. The contactor 72 includes a locator hole 82 that accepts a locator pin 84 on the flange 38 when assembled. The shaft includes a hub 86 that fits through a hub aperture 88 within the contactor 72. As best shown in FIG. 7, the contactor 72 includes contacts 90 and 92. Contacts 90 and 92 make contact with the contact paths 76 and 78 of the PC board 74. When the contactor 72 is rotated with respect to the fixed PC board 74 via the rotating shaft 36, a variable voltage output is created at one of the set of terminals 80. The terminal leads 96 are provided for connectivity purposes to the potentiometer 70. The varying voltage is proportional to the linear motion of the carriage 48. As noted earlier, rotation of the shaft 36 is limited to less than one revolution per full translation of the carriage 48 in order to properly actuate the potentiometer 70.

Figure 9:
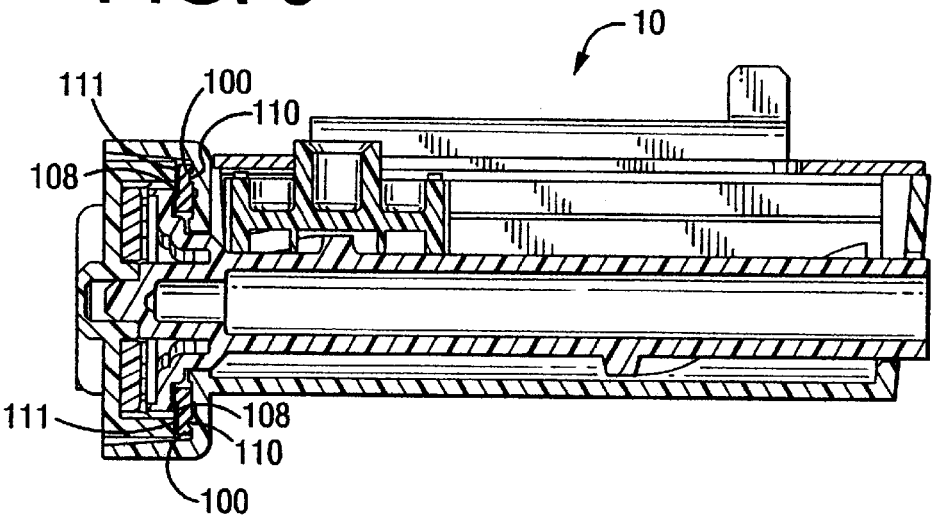
FIG. 9 is a cross-sectional view of the sensor of FIG. 1 taken along a center axis of the shaft.

Referring to FIG. 5, the electrical device compartment 34 is sealed via a device compartment cover 98 and a gasket 100. The gasket 100 is disposed between the flange 38 of the shaft 36 and a surface 102 of the electrical device compartment 34. The gasket 100 is preferably made from a compressible material and includes locator holes 104 that correspondingly engage locator pins 106 within the electrical device compartment 34. Referring to FIG. 9, a rib 108 on the flange 38 compresses the gasket 100 against the surface 102 of the electrical device compartment 34. A rib 110 on the surface 102 is provided to also compress the gasket 100. Furthermore, a rib 111 is disposed on the device compartment cover 98 to provide additional compression of the gasket 100. Thus, a seal is created between the mechanical interface compartment 32 and the electronic device compartment 34 with the single gasket 100. In a preferred embodiment, the gasket 100 includes a Mylar® layer (not shown) disposed such that it faces the flange 38 of the shaft 36. This layer provides a low friction surface to allow the flange 38 to more easily rotate with respect to the compressed gasket 100 without affecting the seal.

The device compartment cover 98 includes a connector shroud 112 around the terminal leads 96. The terminal leads 96 allow for connection of the sensor 10 to the control circuit. The device compartment cover 98 includes snaps 114 that engage the electrical device compartment 34 at slots 116. A mating connector (not shown) may be provided with elastomer seals to further provide sealing. This seal in conjunction with the gasket 100 provides a substantial seal for the electrical device compartment 34 against intrusion by external contaminants. The integrity of the seal is best shown in FIG. 9, wherein the senor 10 is fully assembled and the gasket 100 is compressed by the ribs 108, 110, and 111 to seal the electrical device compartment 34.

The carriage 48 of the sensor 10 is coupled to the pin 18 of the pedal assembly 16, as shown in FIG. 3. The pedal assembly 16 includes two yoke plates 118 that allow the pedal 20 to swing therebetween. As shown in FIG. 2, a clevis 120 is attached to the pedal by the pin 18, thereby allowing the pedal 20 to pivot relative to the clevis 120. A gear train (not shown) of the motorized adjustment mechanism also engages the clevis 120 and causes the clevis 120, and thus the pin 18, to move linearly when a motor (not shown) drives the gear train to adjust the pedal 20.

In operation, the carriage 48 of the sensor 10, which is coupled to the pin 18 of the pedal assembly 16, moves linearly in response to position adjustment of the pedal 20 via the motorized adjustment mechanism. In turn, the linear movement of the carriage 48 causes rotational movement of the shaft 36 via the engagement of the bearing surfaces 44 and 46 of the shaft 36 and the bearing surfaces 50 and 52 of the carriage 48. The shaft 36 causes rotational movement of the contactor 72 in contact with the contactor paths 76 and 78 of the PC board 74 (voltage divider circuit). The voltage divider circuit creates a variable voltage that is proportional to the linear movement of the carriage 48 and the pin 18, and thus, the change in position of the pedal 20.

The control unit 24 is in communication with the PC board 74 via the terminal leads 96. The control unit utilizes the voltage signal to determine whether positioning of the pedal 20 is within a predetermined allowable range with respect to the position of the other pedal or pedals (not shown). The control unit determines this by comparing the values of the voltage signals received by the pedals to a predetermined allowable range of values. The control unit 24 is in communication with the motorized adjustment mechanism 26, which effectuates adjustment of the pedal 20, as schematically depicted in FIG. 4. If the value of the voltage signal for any of the pedals is outside the predetermined range, a fault condition occurs and the control unit 24 disables the adjustment mechanism 26. The adjustment mechanism 26 remains disabled until a technician can evaluate the fault condition and reset the control unit 24.

Alternatively, the voltage signals of more than one pedal can be continuously compared by the control unit 24. If the divergence between all of the voltage signals remain lower than a predetermined divergence value or value range, the control unit will allow normal function of the system. However, in the case of a fault within the system that prevents one pedal from moving while the other pedal or pedals are adjusted, the voltage signals would progressively diverge. Thus, the control unit 24 would interpret a divergence that is greater than the predetermined value, or not within a predetermined range, as a system fault and correspondingly disengage the motorized adjustment mechanism.

In another alternative embodiment, the value of the electrical signal for one or more of the pedals may be monitored in conjunction with a pulse received by a Hall effect sensor in communication with a motor of the motorized adjustment mechanism 26. In this alternative embodiment, a fault condition occurs when a pulse is received from the Hall effect sensor (which indicates that the motor is operating to adjust the pedal) and the electrical signal associated with the appropriate pedal is constant (which indicates that the pedal position remains fixed).

It is to be understood that other values associated with an electrical signal may be utilized to determine the position of the pedal 20. Furthermore, other electrical devices may be used instead of the potentiometer 70, such as a rotary encoder, a rotary switch, or a Hall effect sensor. In the case of a rotary-actuated device, the actuator may be coupled directly to the shaft 36. In the case of a Hall effect sensor, or some other electrical device that utilizes magnetic fields, the shaft 36 may incorporate a magnet that creates a magnetic field when rotated, which affects the electrical device and the associated signal.

In adjustable vehicle pedal systems, the present invention provides a robust design for a sensor to facilitate monitoring of pedal adjustment positions with respect to other pedals. The sensor converts linear movement to rotational movement to provide a more effective rotational sealing arrangement with a compressible gasket rather than relying upon a swipe seal normally associated with a linear motion member. Furthermore, since the sensor is coupled directly to the movement of the pedal rather than the motor that drives the pedal adjustment mechanism, the sensor can detect system failures within the pedal assembly independent of motor movement.

The sensor 10 can also be utilized in other adjustable systems of a vehicle without departing from the scope of the present invention. For example, the sensor 10 can be utilized in an adjustable seat arrangement for an automobile, wherein the sensor 10 can vary an electrical signal in response to position adjustment of the seat. Typically, one sensor would be used for each axis of adjustment. In this type of application, the carriage 48 of the sensor 10 would be coupled to a member that correspondingly moves linearly with respect to each axis of adjustment. Thus, the electrical signals associated with each of the sensors 10 can facilitate determination and control of the positioning of the adjustable seat.

In yet another application, the sensor 10 can be utilized as a adjustable control in an instrument panel that requires a linear motion input by an operator of a vehicle. For example, the sensor 10 can be utilized in a vehicle HVAC system as an adjustable temperature control, wherein an operator can slide the carriage 48 to adjust the temperature output of the heating system of the automobile. The sliding of the carriage 48 would effectuate application of rotary motion to the electrical device of the sensor 10 to provide a variable electrical signal, which can then be used to provide variable temperature control to the system.

While the specific embodiments have been illustrated and described, numerous modifications come to mind without significantly departing from the spirit of the invention, and the scope of protection is only limited by the scope of the accompanying Claims.

What is claimed is:

1. A sensor for an adjustable pedal assembly of a vehicle, the sensor comprising:

a housing having a mechanical interface compartment and an electrical device compartment in communication with the mechanical interface compartment via an aperture in a surface;

a shaft having a helical bearing surface and a flange at one end, the shaft disposed within the housing such that the shaft passes through the aperture and the flange is disposed within the electrical device compartment;

a carriage disposed within the mechanical interface compartment and in communication with the pedal of the vehicle, the carriage slidably moveable within the mechanical interface compartment in response to positional adjustment of the pedal, the carriage including a bearing surface that engages the helical bearing surface of the shaft such that movement of the carriage causes the shaft to rotate; and an electrical device disposed within the electrical device compartment and coupled to the flange of the shaft, the electrical device capable of changing an electrical signal of an electrical circuit in relation to the rotational movement of the shaft.

2. The sensor of claim 1, further comprising a seal disposed between the flange and the surface of the housing having the aperture.

3. The sensor of claim 2, wherein the seal is a compressible gasket.

4. The sensor of claim 2, wherein the seal comprises at least one O-ring.

5. The sensor of claim 1, wherein the electrical device is selected from the group consisting of a potentiometer, a rotary encoder, a rotary switch, and a Hall effect sensor.

6. The sensor of claim 1, wherein the electrical device is a potentiometer comprising a contactor mechanically coupled to the flange of the shaft and a circuit board disposed within the electrical device compartment, the circuit board including conductive elements in contact with the contactor to form a voltage divider circuit.

7. The sensor of claim 6, wherein the rotational movement of the shaft creates a variable voltage in the voltage divider circuit that is proportional to the linear motion of the carriage.

8. The sensor of claim 1, wherein the helical bearing surface of the shaft is disposed on a helical rib that is disposed on the shaft.

* * * * *